US006968949B2

(12) United States Patent
Zivic et al.

(10) Patent No.: US 6,968,949 B2
(45) Date of Patent: Nov. 29, 2005

(54) FILE WITH HIGH-TRACTION SURFACE

(75) Inventors: Jennifer Zivic, East Northport, NY (US); Alicia Cox, Mineola, NY (US); Alan Beck, Brooklyn, NY (US)

(73) Assignee: Esselte Corporation, Melville, NY (US)

( * ) Notice: Subject to any disclaimer, the term of this patent is extended or adjusted under 35 U.S.C. 154(b) by 62 days.

(21) Appl. No.: 10/322,737

(22) Filed: Dec. 19, 2002

(65) Prior Publication Data

US 2004/0118731 A1 Jun. 24, 2004

(51) Int. Cl.[7] ..... B65D 85/00
(52) U.S. Cl. ..... 206/425; 206/806
(58) Field of Search ..... 206/425, 320, 206/494, 554, 806; 40/646, 661, 661.06, 40/657, 661.08; 211/50, 57.1; 248/317, 694; 281/45, 51; 229/67.1, 67.3, 67.4; 312/208.2, 312/223.2, 223.3; 802/73

(56) References Cited

U.S. PATENT DOCUMENTS

| | | | | |
|---|---|---|---|---|
| 2,436,105 A | | 2/1948 | Fisler | |
| 2,755,576 A | | 7/1956 | Golden | |
| 3,073,508 A | | 1/1963 | Hiersteiner | |
| 3,261,119 A | | 7/1966 | King | |
| 3,524,583 A | | 8/1970 | Gregory | |
| 4,713,899 A | * | 12/1987 | Fast | 40/661.08 |
| 4,806,397 A | | 2/1989 | Horwitz | |
| 5,025,979 A | | 6/1991 | Dellacroce | |
| 5,078,231 A | * | 1/1992 | Davis | 182/107 |
| 5,339,967 A | * | 8/1994 | Valiulis | 211/57.1 |
| 5,456,497 A | | 10/1995 | Ross, Jr. | |
| 5,487,617 A | | 1/1996 | Cole et al. | |
| 5,620,133 A | | 4/1997 | Isserstedt | |
| 5,630,509 A | * | 5/1997 | Su | 206/425 |
| 5,692,608 A | * | 12/1997 | Simien | 206/320 |
| 5,741,028 A | | 4/1998 | Hatano et al. | |
| 6,116,412 A | * | 9/2000 | Rogers | 206/806 |
| 6,206,206 B1 | | 3/2001 | Saylor et al. | |
| 6,273,470 B1 | | 8/2001 | Bullock | |
| 6,478,292 B1 | * | 11/2002 | Sellers | 269/289 R |

* cited by examiner

*Primary Examiner*—Luan K. Bui
(74) *Attorney, Agent, or Firm*—Winston & Strawn LLP

(57) ABSTRACT

A file that has a holding portion configured for holding at least one stack of paper at a holding location. A first panel covers the holding location, and a second panel includes a traction surface and is rotatably associated with the first panel for movement between closed and open positions. In the closed position, the second panel is disposed against another portion of the file and in the open position, the second panel extends at an angle from the holding location for resting on a desktop. A traction surface has sufficiently high traction for supporting the holding portion and its held stack hanging therefrom while preventing the second panel from sliding off the desktop.

24 Claims, 7 Drawing Sheets

FILE WITH HIGH-TRACTION SURFACE

FIELD OF THE INVENTION

The present invention relates to a file configured for hanging from a desktop and holding a stack of paper. More particularly, the invention relates to a portable file folder configured to hang in an open position from and without sliding off an edge of a desktop, shelf or other substantially horizontal surface.

BACKGROUND OF THE INVENTION

Portable filing systems or personal organizers for business or for personal use are usually filled with papers and documents of varying size, length, value and importance. Some files include flexible dividers and indexing extensions to aid in differentiating collections or projects. Documents are at times easily lost with conventional filing systems due to the document's odd size or weight. Files that can maintain an open or exposed position can aid the user in identifying, maintaining and retrieving documents.

Files are known with dividers, indexing tabs and additional pockets which open wide and securely close for transport. Some are also made of durable materials which allow occasional exposure to the elements.

Some files incorporate a portion that are slip-resistant to a user's fingers on one or more flaps of the files. U.S. Pat. No. 6,273,470 discloses an expanding file that has a portion on its cover flap, near the top edge that is resistant to slipping from a user's fingers when it is gripped. The slip-resistant portion comprises permanently deformed regions and optional pressure-sensitive adhesive or polymeric material. The slip-resistant portion formed by embossing the paper stock with the material is shown as not being exposed to a user's grip until the user applies pressure to the raised bumps. The bumps collapse under the pressure so the user's fingers come into contact with the material disposed around the bumps of the embossing.

The need exists for a durable file that can be placed on a substantially horizontal surface such as a desktop with a loaded portion hanging off the edge.

SUMMARY OF THE INVENTION

The present invention relates to a file that includes a holding portion configured for holding at least one stack of paper at a holding location. The holding portion comprises a first panel disposed adjacent the holding location and a second panel. The second panel comprises a traction surface and is associated with the first panel for movement between a closed and open positions. In the closed position, the traction surface is positioned adjacent another portion of the file, while in the open position, the traction surface extends at an angle from the holding portion. This construction enables the second panel, in the open position, to be placed on a desktop with the first panel and stack hanging therefrom, with the traction surface in contact with the desktop for providing sufficient gripping to the desktop to support the holding portion and held stack hanging therefrom while preventing the second panel from sliding off the desktop.

The traction surface has a sufficiently high traction for gripping the desktop to support the holding portion and held stack hanging therefrom while preventing the traction portion from sliding off the desktop, which may be provided by a sufficiently high frictional coefficient. In one embodiment, the traction surface can include a tacky traction surface that can be repeatedly released and reused by a user. The second panel can comprise a weighted member or additional layer for keeping a sufficient surface area of the traction surface against the desktop to ensure sufficient traction of the traction surface on the desktop.

The second panel can be sufficiently greater in weight and rigidity than the first panel for preventing the traction portion from sliding off the desktop. A weighted layer of the second panel can provide the increased weight and or rigidity. In one embodiment, the second panel comprises a first layer and a traction layer attached thereto, the traction layer comprising a traction surface which can comprise an elastomeric material. The second panel is configured to function as a file cover for covering at least a portion of the holding portion in the closed position.

The holding portion can also comprise, for example, additional panels, an expandable accordion file, a binding mechanism, a bound article or a pocket to receive the stack. The panels can be continuous and of unitary construction. In the closed file position, the second panel is preferably configured as a file cover and to substantially cover the holding portion or an opening of the pocket thereof where the stack is received.

A hinge can pivotally connect the first panel and the second panel. The holding portion can define an opening associated with the holding location and is configured to receive the stack therethrough for placement of the stack in the holding location. The opening of the holding portion faces the hinge.

DETAILED DESCRIPTION OF THE PREFERRED EMBODIMENTS

Figure 4:
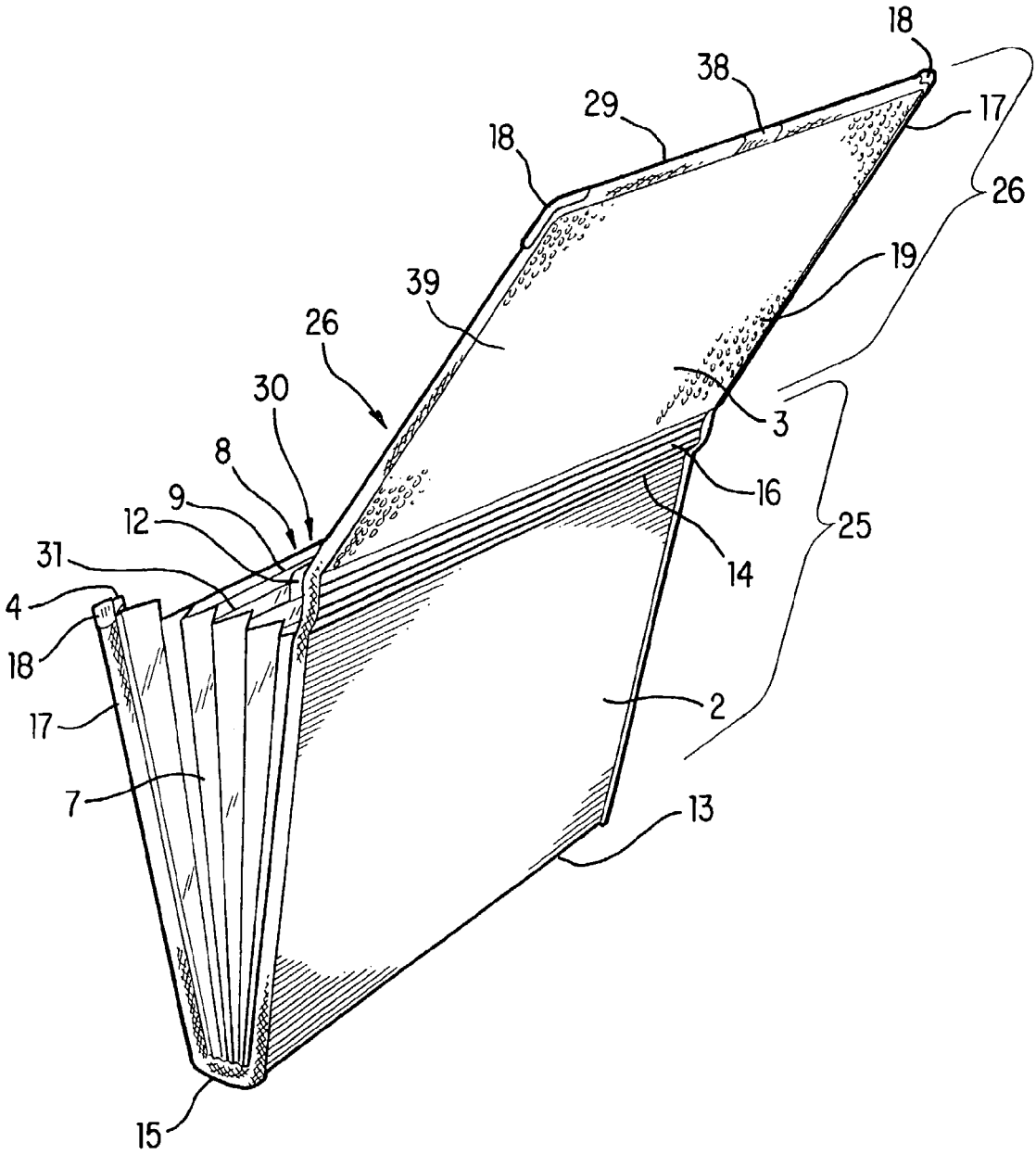
FIG. 4 is a perspective rear view thereof.

Referring to FIG. 4, a preferred embodiment of a file has a holding portion 25 configured for holding at least one stack of paper at a holding location 30. The holding portion 25 includes panels such as a front panel 4 and a back panel 2. The holding location 30 is preferably defined between back panel 2 and front panel 4. A traction portion 26 includes cover panel 3. Preferably the panels are at least semi-rigid and can include partitions that are continuous with each other.

Preferably, the back panel 2 is pivotally associated with a front panel 4 and substantially encloses an interior filing space 8 at the holding location 30. Panels 2,4 can pivot between a loading file position, shown in FIGS. 1 and 2, and a closed file position, shown in FIG. 5. Bottom panel 15 preferably pivotally connects the front and back panels 4,2, and can have scores 13 or other structures to aid in flexibility. The front panel 4, back panel 2 and bottom panel 15 are preferably connected by hinges, such as scored living hinges 13,14. Back panel 2 and front panel 4 can also be attached with file sides 7. The sides 7 may be of the expanding file or accordion file type, with or without integral dividers 9, which partition the interior filing space 8 and holding location 30.

The integral dividers 9 are preferably 0.18 mm thick, yet may be thinner for smaller embodiments or where greater flexibility is required. Alternatively, the dividers 9 may be thicker for larger embodiments or where greater rigidity is required.

Preferably, superior boundaries of the front panel 4, back panel 2 and sides 7 define an upward facing opening 31 adjacent the proximal edge of the traction portion 26. The sides 7 are configured to keep the holding portion 25 in a file loading configuration while sufficiently supporting the held stack.

The filing space 8 is preferably configured to contain papers of standard sizes to be used in an office environment, such as letter, legal, A3 or A4. Larger filing spaces 8 can be configured to accommodate the needs of artists, teachers, cartographers and draftspeople. Other embodiments that accommodate personal checks, bills, invoices, business cards, currency and receipts are possible.

The panels 2,3,4 are preferably between 0.9 mm and 0.65 mm thick, yet may be thinner for smaller embodiments or where greater flexibility is required. Alternatively, the panels 2,3,4 may be thicker for larger embodiments or where greater rigidity is required.

Figure 1:
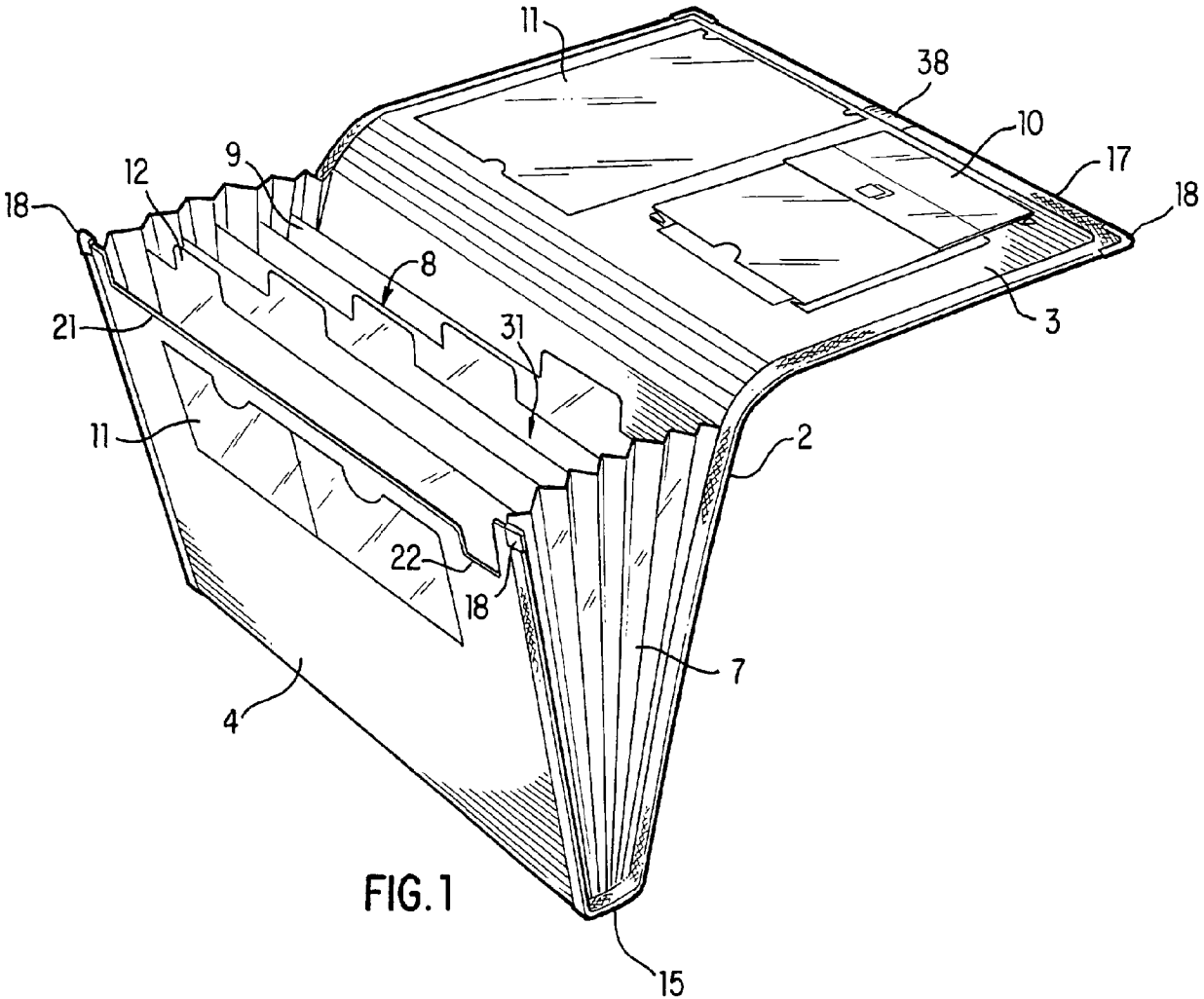
FIG. 1 is a perspective view of a preferred embodiment of a file constructed according to the present invention.
Figure 2:
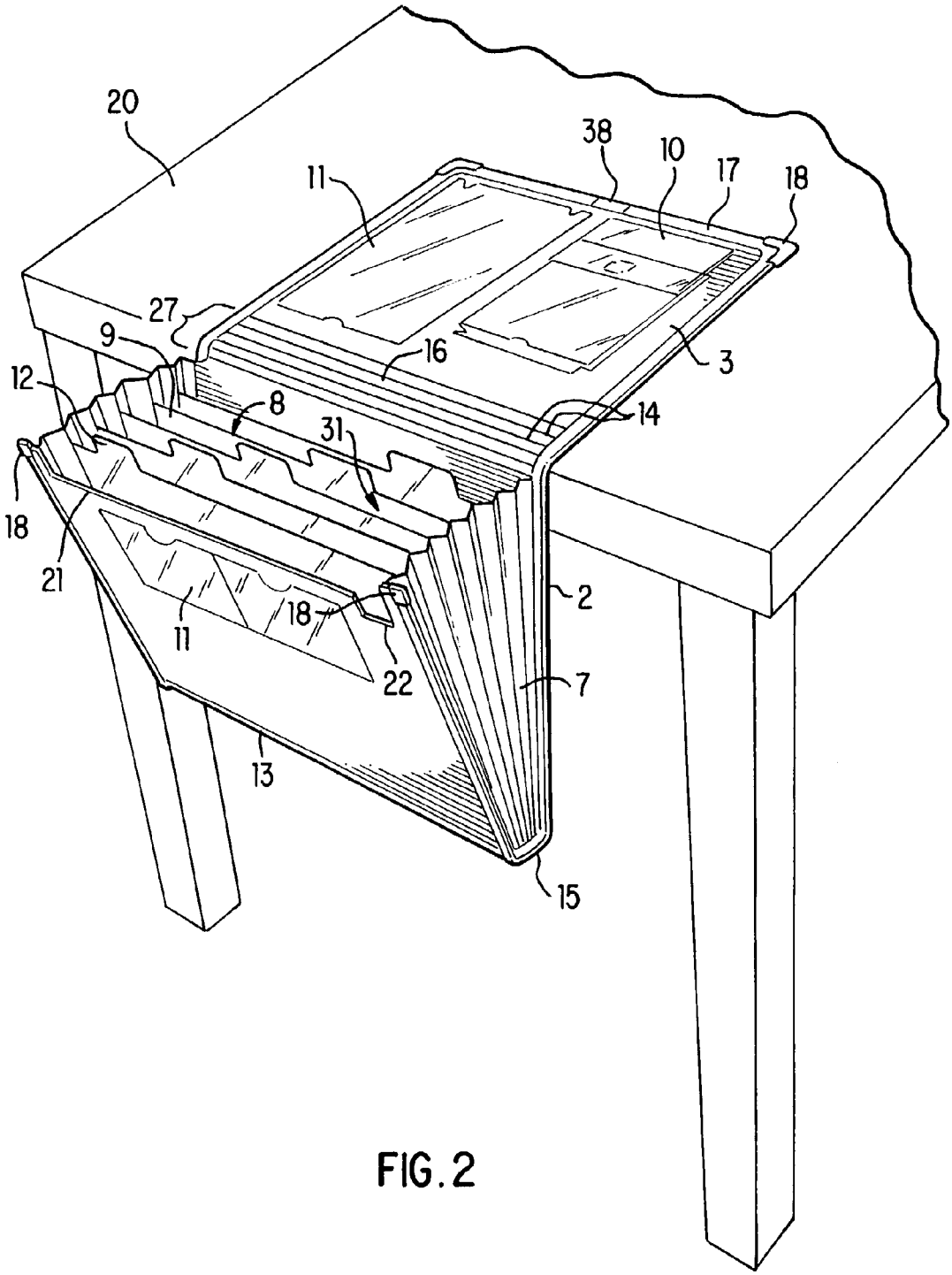
FIG. 2 is a perspective view thereof in an open position.
Figure 3:
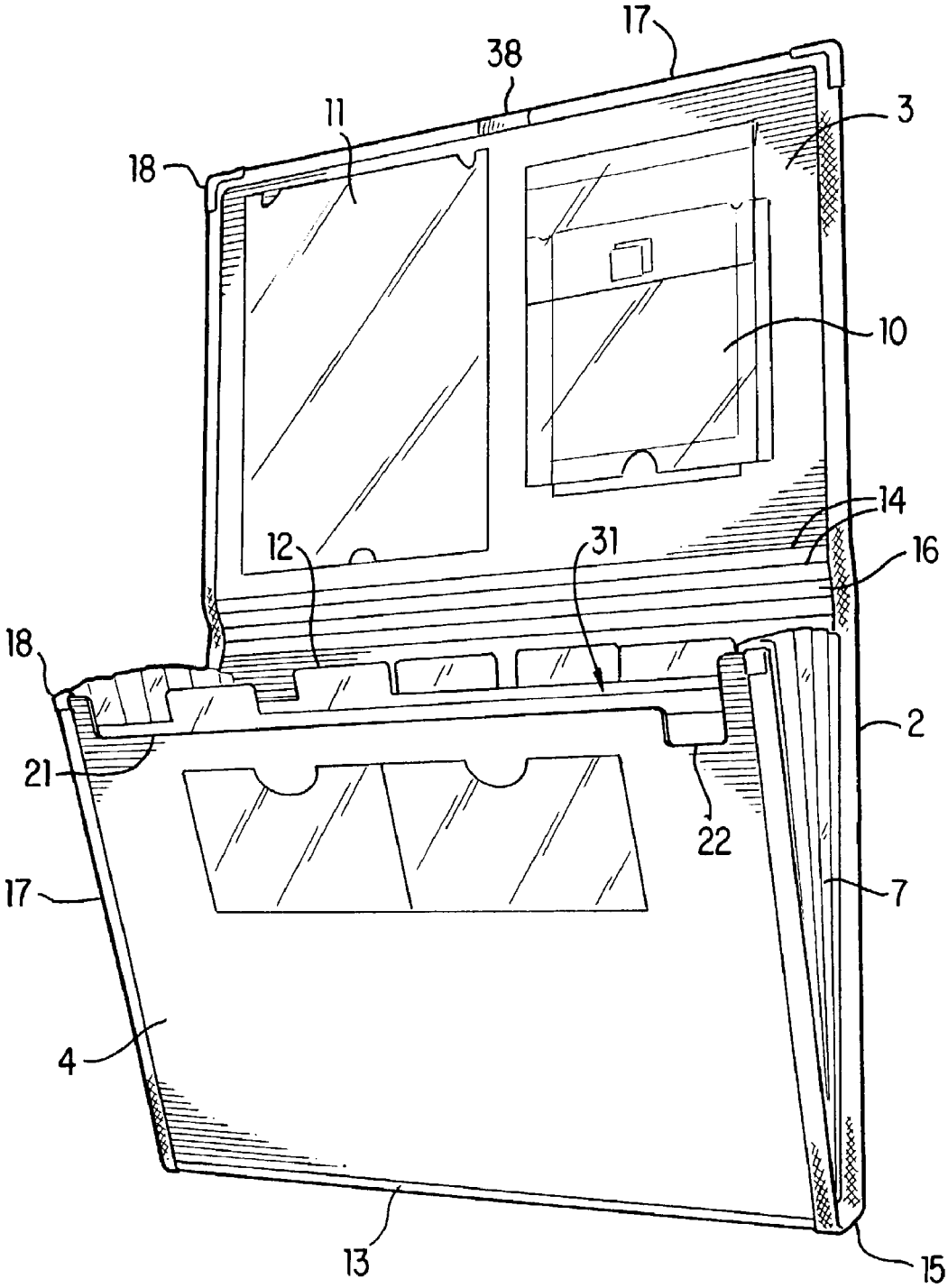
FIG. 3 is a perspective front view thereof.

Referring to FIGS. 1–3 the front panel 4 of the preferred embodiment has a notch 21 extending substantially across its entire width above which indexing extensions 12 are viewable in the open file position. Additionally there may be a secondary notch 22 continuous with the first as shown in FIGS. 1–3. One or more transparent or opaque pockets 11 can be attached to a face of the front panel 4 for holding smaller items such as labels or photographs. Hooks, clips and clasps may also be found the face of the front panel 4.

Figure 5:
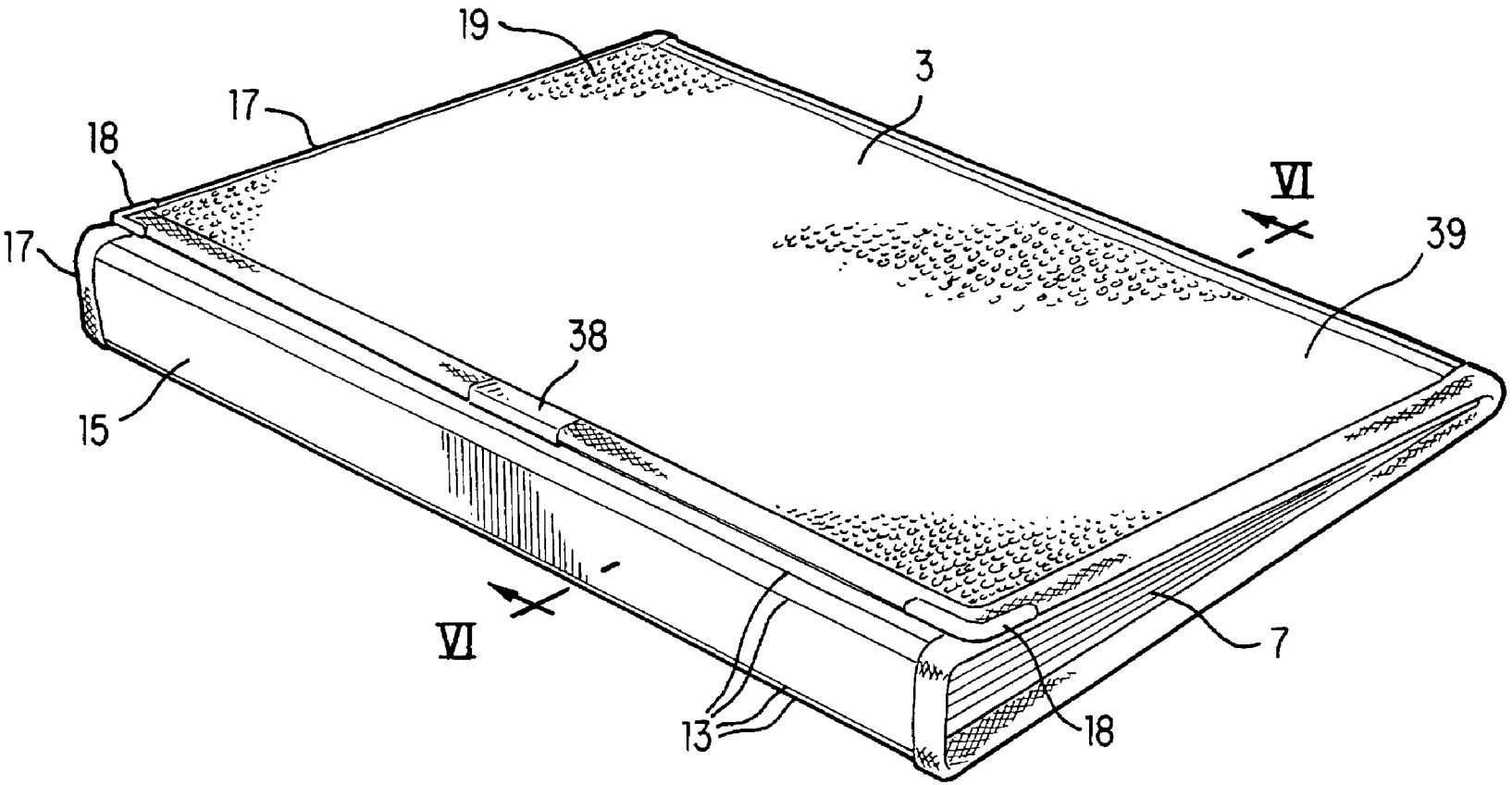
FIG. 5 is a perspective view thereof in a closed position.
Figure 6:
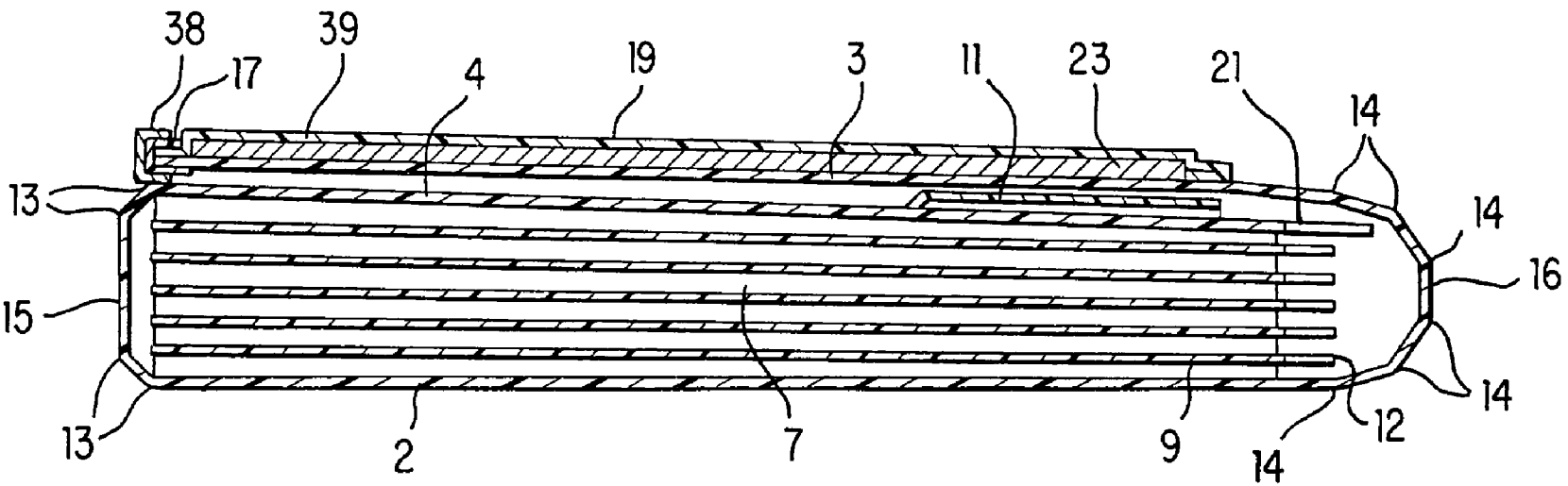
FIG. 6 is a cross-sectional side view thereof along plane VI—VI, shown in FIG. 5.

Cover panel 3 and back panel 2 are rotatably associated at hinge portion 16 for pivotal movement between a closed file position, as shown in FIG. 5, and an open position wherein the cover panel 3 extends at an angle from the back panel 2, as shown in FIG. 2. In the closed file position the cover panel 3 is configured to work as a cover and substantially cover the holding location 30. As shown in FIGS. 5 and 6, the cover panel 3 if this embodiment has a substantially flat confirmation to lie substantially flat against the holding portion 25 in the closed position. In the open position the cover panel 3 can rest on a desktop with the holding portion 25 and its contents hanging therefrom. Cover panel 3 can include a top panel 16 which may include scores 14 for added flexibility to form a hinge 27. In other embodiments, the various panels are hinged with rings, a spiral or other types of hinges.

Preferably, a distal edge 29 of the cover panel 3 and lateral edges of panels 2,4,15,16 are bordered with a reinforcing piping 17 as shown in FIG. 4. Nylon webbing is the preferred material for the reinforcing piping 17, but any other material with sufficient pliability and durability can be alternatively used.

Chafe clips 18 are preferably attached at the ends of the reinforcing piping 17 and at the distal corners of the cover panel 3, as shown in FIGS. 1–5. A chafing clip 38 can also be attached to the center of the distal edge 29 of cover panel 3. The clips 18 are preferably made of metal, can be painted, anodized or coated, or made of other durable material. The clips 18,38 are normally crimped onto the reinforcing piping 17, and may be added elsewhere.

Referring to FIGS. 4–6, the file has a traction portion 26, which is configured for gripping the desktop or other substantially horizontally surface while supporting the holding portion 25 hanging therefrom. Preferably the cover panel 3 includes a traction layer 39 which includes a traction surface 19. The traction surface 19 has a sufficiently high traction for gripping a desktop 20 as shown in FIG. 2 to support the holding portion 25 and a held stack or other contents hanging from the cover panel 3 while preventing the cover panel 3 from sliding off the desktop 20. The distal and lateral edges of the traction surface 19 are preferably tucked and securely attached beneath the reinforcing piping 17 to an inner panel 23, which is preferably of unitary construction with the second 3 and first panels 2 or portions thereof. A proximal edge of the traction surface 19 adjacent to the top panel 16 is tucked underneath itself toward a center of panel 3 where it is securely attached to inner panel 3. Glues and adhesives can be used for attaching the traction surface 19 to the inner panel 3, while other securing methods such as welting, welding and stitching are also possible.

A preferred material for the traction layer 39 is PVC foam. Suitable materials of the traction layer 39 include elastomers, acrylics, vinyls, rubber-based and other materials with a sufficiently high traction for gripping the desktop to support the holding portion 25 and held stack. Additionally, the traction layer 39 can include tacky materials such as glues and adhesives to increase traction by repeatably adhering to the desktop.

Figure 7:
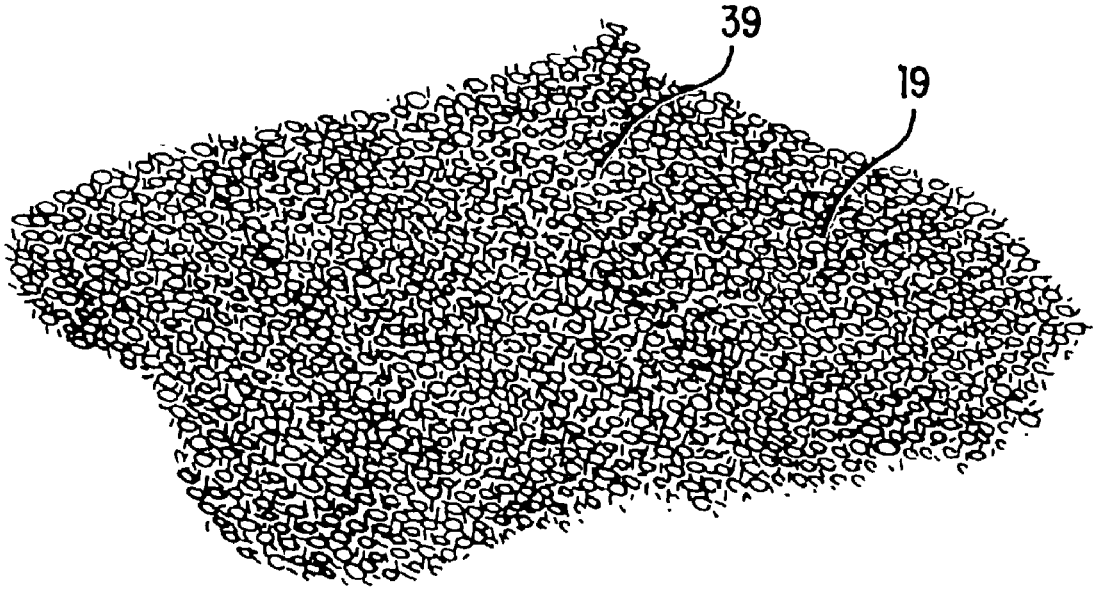
FIG. 7 is a perspective view of the preferred traction layer and its surface.

As shown in FIG. 7, the preferred traction surface 19 has a dimpled porous texture, and alternative embodiments have a bumpy texture, or one that is substantially level and flat. Regular and random patterns are also possible for the traction surface 19 as are treads, pimples, grooves and beads. In one embodiment, a traction portion 26 can be used that is of unitary construction with the second panel 3.

Referring to FIGS. 5 and 6, the cover panel 3 is preferably heavier, thicker and substantially more rigid than the other panels. As visible in FIG. 6, the cover panel 3 has a substantially flat cross-section and is configured to lay substantially flat against the holding portion 25 in the closed position, with the outside of the cover panel 3 also being substantially flat. To increase the traction of the traction surface 19, the cover panel 3 may contain a weighted insert 23, which is preferably disposed between an inner and traction layers 3,39. The weighted insert 23 may comprise multiple layers. The weighted insert 23 lends thickness to the cover panel 3 and prevents the traction surface 19 from laying flush with the reinforcing piping 17, thus exposing more area of the traction surface 19 to the desktop and increasing traction. The weighted insert 23 also lends greater weight to the cover panel 3, thus increasing traction between the traction surface 19 and the desktop 20. The weighted insert 23 can also increase the stiffness and weight of the cover panel 3 to improve contact of the traction surface 19 with the desktop 20.

Preferably, the weighted insert 23 is 4.2 mm thick, yet may be thinner or lighter for some embodiments. Alternatively the weighted insert 23 may be thicker or heavier for other embodiments.

In the closed position, cover panel 3 is configured as a file cover for covering at least a portion of the holding portion. Preferably at least 25% of a front of the holding portion or of the front panel is covered by the cover panel 3, more preferably at least 50% and most preferably at least 75%. Cover panel 3 can also substantially cover all of the front of the holding portion or the front panel.

As shown in FIGS. 4 and 5, the weighted insert 23 preferably generally conforms to the area covered by the traction surface 19, but may be of different shape, size, density and thickness.

The traction surface 19 covers a majority of an outer side area of the cover panel 3 as shown in FIGS. 4 and 5. The preferred area of coverage is rectangular and extends from adjacent the top panel 16 toward a distal edge 29 of the cover panel 3 within the reinforcing piping 17. The traction surface 19 can alternatively cover a lesser area of the outer side of the cover panel 3.

In other embodiments, the area covered by the traction surface 19 is less than about 50% or less than about 25% of the area of the cover panel 3. Preferably, the traction surface 19 extends proximal the top panel 16. The area covered by the traction surface 19 is preferably rectangular and centered between the edges of the cover panel 3. Other embodiments have a different positioning and shaping of the traction surface 19 which may be discontinuous. Many configurations of the traction surface 19 are possible, providing the traction surface 19 has sufficiently high traction for supporting the filing space 8 and held stack hanging therefrom while preventing the cover panel 3 from sliding off the desktop 20.

One or more secondary envelopes 11 or secondary pockets 10 can be attached to exposed faces of each of the panels 3,4. As shown in FIGS. 1–3, an expanding type pocket 10 and a secondary envelope 11 are located on an inner side of the cover panel 3. Other combinations and permutations of variously sized secondary pockets 10 and secondary envelopes 11 can be used. Hooks, clips and clasps may also accompany the faces of the panels 3,4.

The stack held in the holding portion 25 may comprise a stack of paper or other material, from a single sheet to a full ream or more. A stack may also be a collection of documents, photographs, facsimiles or other material that requires filing. Preferably, the file can hang from a desktop while holding at least about 10 lbs. of sheets. In another embodiment at least 5 lbs. of sheets can be held.

While illustrative embodiments of the invention are disclosed herein, it will be appreciated that numerous modifications and other embodiments may be devised by those skilled in the art. For example, the holding portion can include alternative structures to hold its contents, such as a ring binding mechanism, photo album, CD album or a bound ledger. Therefore, it will be understood that the appended claims are intended to cover all such modifications and embodiments that come within the spirit and scope of the present invention.

What is claimed is:

1. A file, comprising:

a holding portion comprising:

a first panel disposed adjacent a holding location, and a holding member associated with the first panel and being dimensioned and having a configuration for holding and retaining a stack of paper in the holding location; and a second panel comprising a high-traction surface and being associated with the first panel for movement between a closed position where the high-traction surface is positioned adjacent another portion of the file and an open position where the high-traction surface extends at an angle from the holding portion, the high-traction surface having a sufficiently high frictional coefficient to increase the traction and gripping against a desktop;

wherein, in the open position, the second panel can be placed on the desktop with the first panel and stack hanging therefrom, and the frictional coefficient is sufficiently high such that with the high-traction surface in contact with the desktop, the high-traction surface provides sufficient traction and gripping to the desktop to support the holding portion and held stack hanging therefrom while preventing the second panel from sliding off the desktop.

2. The file of claim 1, wherein at least portions of both the first panel and second panel are of continuous and of unitary construction.

3. The file of claim 1, wherein the second panel is configured as a file cover for covering at least a portion of the holding portion in the closed position.

4. The file of claim 1, wherein the file comprises a file folder.

5. The file of claim 1, wherein the holding member comprises a pocket that has a configuration, dimensions, and sufficient volume to hold the stack of paper of at least letter, legal, A3, or A4 size therein at the holding location.

6. The file of claim 5, further comprising a hinge that pivotally connects the first panel and the second panel, wherein the pocket defines an opening associated with the holding location and configured to receive the stack therethrough for placement in the holding location, the opening facing the hinge.

7. The file of claim 5, wherein the pocket comprises an expandable accordion pocket.

8. The file of claim 1, wherein the holding portion defines an opening, the opening being positioned to face generally upwardly when the holding portion hangs from the second panel from the desktop.

9. The file of claim 6, wherein the pocket comprises a third panel disposed on an opposite side of the holding location from the first panel, a bottom wall, and two side walls disposed on opposite sides of the holding location, which define a pocket holding space.

10. The file of claim 9, wherein at least portions of the first, second and third panels are of a unitary construction.

11. The file of claim 1, wherein the second panel comprises a first layer and a traction layer attached thereto, the traction layer comprising the high-traction surface.

12. The file of claim 11, wherein the traction layer comprises an elastomeric material.

13. The file of claim 11, wherein the second panel comprises a second layer which significantly increases the weight and rigidity of the second panel to increase the friction between the second panel and the desktop.

14. The file of claim 13, wherein the second panel is substantially greater in weight and rigidity than the first panel for increasing friction between the second panel and the desktop and preventing the holding portion from sliding from the desktop.

15. The file of claim 1, wherein the second panel is weighted to provide further support for the first panel when the second panel is in the open position.

16. The file of claim 1, wherein the holding member is configured and dimensioned to hold the stack of paper of at least letter, legal, A3, or A4 size in the holding location.

17. The file of claim 1, wherein the holding member has sufficient dimensions and configuration, and the high-traction surface has a frictional coefficient that is sufficiently high to increase the traction and gripping against the desktop, to support the holding portion when holding a stack of paper weighing at least about five pounds in the holding location.

18. The file of claim 3, wherein the cover panel has a substantially fiat cross-section and is configured to be lay substantially flat against the holding portion in the closed position.

19. The file of claim 1, wherein the holding member comprises a binding mechanism that is dimensioned and configured to hold the stack of paper in the holding location.

20. The file of claim 1, wherein the high traction surface has a dimpled or porous texture sufficient to provide the sufficiently high frictional coefficient to increase the traction and gripping against the desktop.

21. A file, comprising:

a holding portion comprising:

a first panel disposed adjacent a holding location, and a holding member associated with the first panel and being dimensioned and having a configuration for holding and retaining a stack of paper of at least letter, legal, A3, or A4 size in the holding location; and a second panel comprising a weighted layer and a traction layer comprising a high-traction surface, the second panel being rotatably associated with the first panel for movement between a closed position against the holding portion and an open position extending at an angle from the holding portion for resting on a desktop;

wherein the high-traction surface comprises an elastomeric material that has a frictional coefficient that is sufficiently high to increase traction and gripping against the desktop to support the holding portion and held stack hanging therefrom while preventing the second panel from sliding off the desktop.

22. The file of claim 21, wherein the holding member is configured and dimensioned, and the high traction surface has a frictional coefficient that is sufficiently high, to support the holding portion when holding a stack of paper weighing at least about five pounds in the holding location.

23. A combination of a file and a stack of paper, the combination comprising:

the file of claim 1; and a stack of paper of at least letter, legal, A3, or A4 size held by the holding member in the holding location.

24. A combination of a file and at least one stack of paper, the combination comprising:

at least one stack of paper;

a holding portion comprising:

a first panel disposed adjacent a holding location, and a holding member associated with the first panel and comprising a pocket having sufficient volume and dimensioned and configured to hold the stack of paper therein at the holding location; and a second panel comprising a high-traction surface and being associated with the first panel for movement between a closed position where the high-traction surface is positioned adjacent another portion of the file and an open position where the high-traction surface extends at an angle from the holding portion, the high-traction surface having a sufficiently high frictional coefficient to increase the traction and gripping against a desktop;

wherein, in the open position, the second panel can be placed on the desktop with the first panel and stack hanging therefrom, with the high-traction surface in contact with the desktop for providing sufficient gripping to the desktop to support the holding portion and held stack hanging therefrom while preventing the second panel from sliding off the desktop.

* * * * *

UNITED STATES PATENT AND TRADEMARK OFFICE

CERTIFICATE OF CORRECTION

PATENT NO. : 6,968,949 B2
DATED : November 29, 2005
INVENTOR(S) : Zivic et al.

It is certified that error appears in the above-identified patent and that said Letters Patent is hereby corrected as shown below:

Column 6,
Line 65, change “fiat” to -- flat --; and before “lay”, delete “be”.

Signed and Sealed this

Thirty-first Day of January, 2006

JON W. DUDAS
*Director of the United States Patent and Trademark Office*